United States Patent [19]

Anthony

[11] 4,221,293

[45] Sep. 9, 1980

[54] CONTAINER FOR FACIAL TISSUES

[75] Inventor: Alfred A. Anthony, Nokomis, Fla.

[73] Assignee: Design Accessories Inc., Westport, Conn.

[21] Appl. No.: 28,182

[22] Filed: Apr. 9, 1979

[51] Int. Cl.[3] ..... B65D 83/00

[52] U.S. Cl. ..... 206/494; 220/4 B; 220/306

[58] Field of Search ..... 206/494, 210, 205; 220/4 B, 4 E

[56] References Cited

U.S. PATENT DOCUMENTS

| | | | |
|---|---|---|---|
| 2,341,092 | 2/1944 | Gooden | 220/4 B |
| 2,998,896 | 9/1961 | Miller | 220/4 B |
| 3,145,840 | 8/1964 | Wright | 206/494 |

*Primary Examiner*—William T. Dixson, Jr.
*Attorney, Agent, or Firm*—Daniel J. Reardon

[57] ABSTRACT

A generally spherical container for dispensing facial tissues or the like is formed by two hemispherical sections interfitting detachably. The upper section has an access opening formed therein and the lower section is weighted at its bottom so that the opening will rotate towards the direction of travel of a tissue being removed from the container to lessen the stress on the tissue, and yet the container will return to its initial position after the tissue is removed.

12 Claims, 3 Drawing Figures

CONTAINER FOR FACIAL TISSUES

BACKGROUND OF THE INVENTION

The present invention relates to a container for dispensing facial tissues or the like.

Known forms of container for dispensing facial tissues generally include a rectangular container having a flat bottom surface and an access opening in a top surface parallel to the bottom surface. The facial tissues are typically stacked in a conventional interlocking or overlapping manner within this container in such a manner that as a tissue is pulled from the container, the leading edge of the adjacent tissue is brought outside the container, for easy access and subsequent withdrawal.

Facial tissues have, by their very nature, relatively little tensile strength, and thus tend to tear upon withdrawal from the known forms of containers described above.

SUMMARY OF THE INVENTION

Consequently, it is an object of the present invention to provide a container whereby the stress placed upon a tissue during its withdrawal from the container will be reduced.

It is a further object of the present invention to provide such a container which is relatively inexpensive to manufacture and can be easily refilled.

According to the present invention, a container for facial tissues or the like is made generally spherical and includes two sections; one, an upper detachable section preferably hemispherical in general shape and a lower or base portion of generally hemispherical conformation. The lower section has an upper rim portion and a rounded bottom surface, while the upper section has a lower rim portion which interfits detachably with the rim portion of the lower section. The lower section is weighted at its bottom portion, and the upper section has an access opening formed therein. In this way, the opening will tend to rotate toward the direction of travel of a tissue being removed from the container and yet the container will return to its initial position after the tissue is removed.

Preferably, the upper rim portion has a top wall and a circumferential recess spaced downwardly from its ledge portion. The ledge portion is adapted to seat on the top wall and the projection is adapted to fit within the recess. In this way, the sections can be held detachably together. The outer wall portion of the projection may extend inwardly and downwardly to provide a camming surface which enables the sections to be joined more easily. Further, the side wall of the upper section may taper towards the lower rim portion to increase its resiliency.

The foregoing as well as other objects, features and advantages of the present invention will become apparent from the following detailed description and accompanying drawings of illustrative embodiments of the invention.

Figure 1:
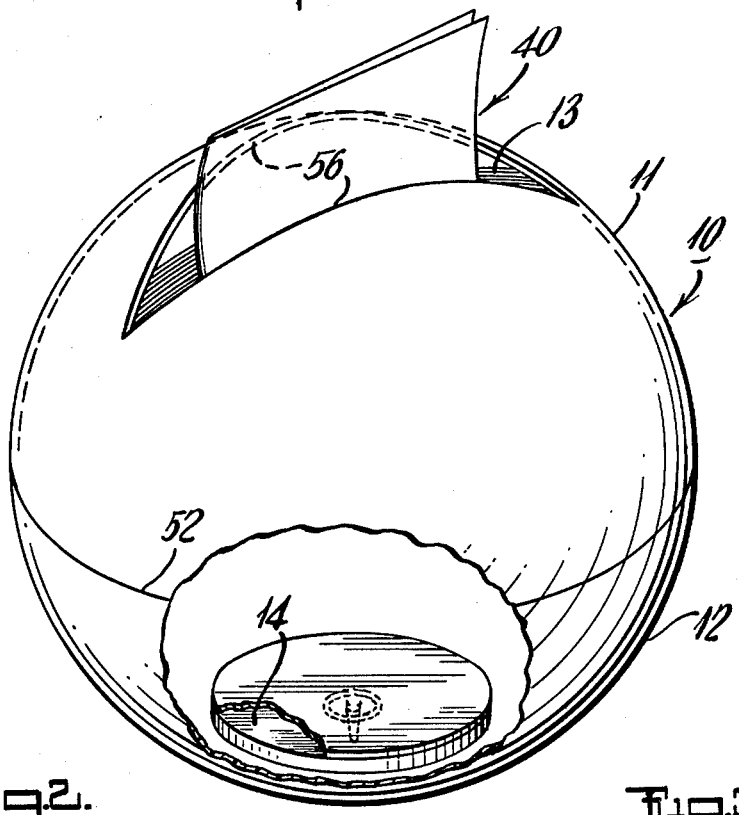
FIG. 1 is a side elevation, partially broken away, of an illustrative embodiment of the present invention.

DESCRIPTION OF PREFERRED EMBODIMENT:

The container 10 shown in the drawings has a generally spherical shape and is formed by two section 11 and 12 each preferably formed as a unitary piece of a synthetic plastic material. Upper section 11 and lower section 12 are each preferably hemispherical in shape and interfit together so that their outer surfaces are flush.

The lower section 12 is weighted at its bottom portion 13 by suitable means. As shown in FIG. 1, a weight 14 may be placed in the inner surface of the bottom portion 12*a* of the bottom section 12 and secured thereto or, alternatively, a suitable weight may be embedded within the wall of the bottom portion during molding of the lower section. The weight should be of sufficient size and weight so as to greatly lower the center of gravity of the container for purposes to be explained fully below. In the illustrative embodiment, a weight formed from a metal mass to generally the shape of an 0-ring and weighting between 2.5 to 5 ounces is preferred.

In a preferred embodiment, the flattened cylindrical weight 14 is disposed under a removable disc 60. The plastic disc has a centrally and downwardly projecting ring 62 that fits within the axially disposed orifice 64 of the weight 14 and is force fit onto an angle pin 66 projecting upwardly from the inner surface 12*a* of the bottom section 12. When forced onto the projecting angle pin 66 of the lower hemisphere, the outer surface of the ring is made of a resilient metal or plastic and is adapted to expand against the inner diameter of the weight 14 as the distance of insertion of the pin 66 in the ring 62 increases, thus locking the weight in place and eliminating the movement and rattle of the metal weight. In significantly less preferred embodiments the disc can be inserted by standard sonic welding and heat or mechanical distortion techniques.

The upper section 10 has a part 13 formed therein, serving, in a significantly preferred embodiment, as an access opening; for removal of a single or series of tissues from the interior of the container. The opening may be of a size sufficient to permit introduction of an assembled group or stack of tissues into the container. The opening is preferably centered in the dome of the upper section and formed by cutting a sector from the upper section 10. Alternatively, the opening 13 could be formed during a molding of the upper section.

The upper section 11 has a lower rim portion 15, and the lower section 12 has an upper rim portion 16. The rim portions are each circular and have respective structures interfitting with one another to hold the two sections 11 and 12 together detachably.

Figure 2:
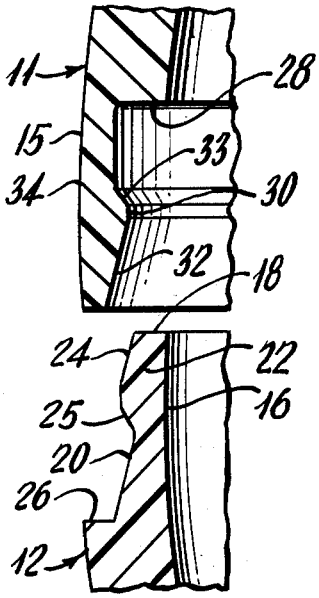
FIG. 2 is an enlarged fragmentary vertical section showing the interconnecting means of the upper and lower rim portions of one illustrative embodiment prior to engagement but in proximity to one another.

As illustrated in the enlarged section of FIG. 2, the rim portion 16 of the lower section includes a top wall 18 and a circumferential recess 20 spaced downwardly from the top wall 18. A side wall portion 22 extends between the top wall 18 and the recess 20, and this side wall portion presents an outer surface 24 which preferably is sloped outwardly in its initial downward path and flattened to define a vertical drop adjacent the upper border of the recess 20 as shown in FIG. 2. Also, as shown in FIG. 2, the recess 20 has an upper surface 25 sloped upwardly and outwardly. The rim portion is unitary with the lower section 12 and, as shown in FIG. 2, has a reduced thickness beginning from the cut-out 26.

The rim portion 15 of the upper section has a ledge portion 28 recessed from the inner surface of the upper section. This recessed ledge portion has a thickness substantially the same as, or greater than that of, the top wall 18 of the rim portion 16 and seats upon the top wall 18 when the two sections are joined together. Spaced downwardly from the ledge portion 28 is a circumferential projection 30 having a vertical section substantially complementary with the circumferential recess 20 of the rim portion 16. Further, as shown in FIG. 2, the projection 30 has an inner wall portion 32 which may extend outwardly and downwardly, and an upper wall portion 33 sloped upwardly and outwardly with respect to the outer surfaces 34 of the upper rim 15. The rim portion 15 is formed unitarily with the upper section 11.

Figure 3:
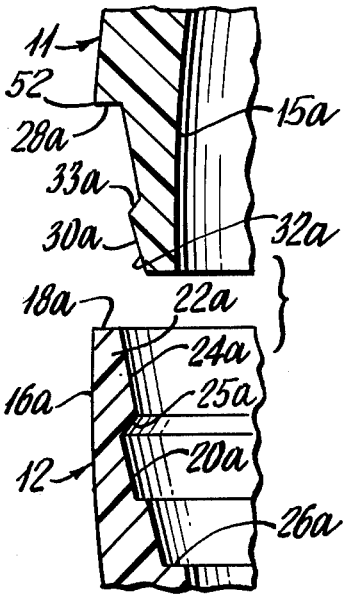
FIG. 3 is an enlarged fragmentory vertical section showing the interfitting means between the two rim portions in a alternative embodiment prior to engagement but in proximity to one another.

In the alternative and less preferred embodiment of FIG. 3 the rim portion **16*a* of the lower section 12 is disposed outside of the lower rim section 15*a* of the upper section or hemisphere 11. As shown in FIG. 3 the rim portion 16*a* of the lower section includes a top wall section 18*a* and a circumferential recess 20*a* spaced downwardly from the top wall 18*a*. A side wall portion 22*a* extends between the top wall 18*a* and the recess 20*a*. The latter side wall 22*a* presents an inner wall surface 24*a* that is sloped inwardly as shown in FIG. 3. Also, as shown in FIG. 3, the recess 20 has an upper surface 25*a* sloped upwardly and outwardly. The rim portion 16*a* is unitary with the lower section 12 and is shown in FIG. 3, has a reduced thickness beginning with the cut-out 26*a***.

The rim portion **15*a* of the upper section 11 has a ledge portion 28*a* recess, in this embodiment, from the outer surface of the upper section. This recessed ledge has a thickness substantially the same as that of the top wall 18*a* of the rim section 16*a* and seats upon the top wall 18*a* when the two sections are joined together. Spaced downwardly from the ledge 28*a* is the circumferential projection 30*a* having a vertical section construction substantially complementary to that of the circumferentially disposed recess 20*a* of the rim portion 16*a* of the lower section 12. Further as shown in FIG. 3, the projection 30*a* has an outer wall portion 32*a* which extends, in the illustrative embodiment of FIG. 3 inwardly and downwardly, and an upper wall portion 33*a* sloped upwardly and inwardly. The rim portion 15*a* is formed unitarily with the upper section 11**.

The hemispheres are formed of rigid but resilient plastic or material of like character so that the rim sections in the embodiment of FIGS. 2 and 3 can be readily snapped onto, and removed from, one another. The wall of the upper section tapers, becoming less thick as it approaches the rim section 15 or **15*a*** in a preferred embodiment for the purpose of enhancing this resiliency.

Thus, in use in accordance with the embodiment of the drawing, a stack of facial tissues 40 is first inserted in the lower section 12. The lower tissues of the stack may be secured to the bottom portion of the lower section by suitable means. Normally and preferably, however, the tissues are simply inserted into the lower hemispherical section after being doubled over in standard interlocked assembly. Alternatively, the weight 14 will not be secured to the bottom portion 12i a so that it may be placed within the stack of tissues near the bottom thereof.

The upper section 11 is then fitted onto the lower section 12. Due to the inherent resiliency of the tapered side wall 32 or **32*a* of the upper section and the reduced thickness of the rim portion 16 and 16*a* of the lower section in the embodiments of FIGS. 1 and 2 respectively, the wall portion 32 and 32*a* of the projection rides along the surface 24 or 24*a* and, by a camming action, is deflected inwardly of the rim portion 16 or 16*a* until the projection 30 or 30*a* snaps within the complementary recess 20 or 20*a* respectively. In this way, the two sections are held together. The sections may also be easily detached for later refilling of the container due to the flattened and inclined upper surface 25 or the inclined surface 25*a* of the recess and inclined upper wall portion 33 or 33*a* respectively on the projections 30 and 30*a***.

In use, the first tissue of the stack is made to extend outwardly from the opening 13. When this first tissue is to be withdrawn from the container, it is simply pulled outwardly, the pulling force having typically a lateral component. In prior devices, the tissue being withdrawn will normally be forced to travel upwardly from the stack and then laterally in the direction of pulling, and removal and this change of direction places undue stress on the tissue and tends to dislocate the container in the direction in which the tissue is being pulled thus defeating or inhibiting successful tissue removal and requiring that one restrain, in any event, the displacement of the container.

In the container according to the present invention, however, the container will rotate during withdrawal of the tissue so that the opening 12 will tilt towards the direction of travel of the tissue. In this way, the tissue will be forced to travel in only one direction to substantially reduce the stress placed thereon. After the tissue is withdrawn, the container will always return to its upright position due to its low center of gravity provided by the weighted bottom portion.

There is thus provided in the container 10 a lower hemispherical base section 12 and an upper section 11, the former incorporating the part or opening 13 and the latter, at least, hemispherical in shape, and having, additionally, a centered weight; said weight and opening being diametrically opposed to one another when the sections of the container are in the assembled state, in a significantly preferred embodiment. As a result, the container 10 manifests a gravitational memory in any of 360° of displacement and is capable of rotation in any of 360° as well. Thus, the outer conformation of the two sections of the container may vary in shape from the spherical in significantly less preferred embodiments so long as the bottom surface of the lower section is rounded.

In the preferred embodiment of FIG. 1, the wall constituting the lower section 12 is of uniform thickness although it may be thickened about its base or weighted pole **12*a* incorporating the weight 14 but the wall constituting the upper section 11 is tapered and of increased thickness adjacent the lips or edges 56 of the orifice or port 13 to reduce the resilience and increase the strength of the container wall at this point. The opening or port 13, as shown in the drawing, is slotted or elongate, the edges intersecting at acute angles at the opposite ends; The greatest distance between the opposed edges occuring midway between the opposite ends defined by the foregoing acute angles thus permitting ready access to and withdrawal of, tissues, at this point; the lateral margins of the tissue following readily and with minimum stress. It will be apparent that while the two sections 11 and 12 are shown as hemispheres which when assembled provide a sphere interconnected by the fitting means described hereinabove located equidistant between the opposite poles thereof, the dimensions of the upper and lower sections may be so varied that the fitting means is moved towards the pole of either the upper or lower section. Similarly the fitting means which defines a flush outer joint 52 as shown in FIG. 1 may, as opposed to the single plane described in FIG. 1**, describe a wave, or jagged conformation in which the borders of the respective sections complement each other.

The number of sections forming the container 10 may be varied to exceed two in number with a plurality of fitting means but this variation increases significantly the cost of manufacture and is substantially less preferred from the aspect of function as well. The joint 52 and fitting means, whether one or a plurality may also be varied from a generally horizontal plane to an angle preferably not in excess of 45% from the horizontal.

It will be evident, too, that the opening 13 as shown in FIG. 1, is significantly preferred in the practice of the invention, openings of various geometric design and differing dimensions may be substituted therefor.

While the present invention has been described and illustrated with reference to a particular illustrated embodiment, it will be apparent that the new features of the invention may also be employed in other forms while still incorporating the invention which is defined by the appended claims.

What is claimed is:

1. A container for dispensing facial tissue or the like, said container being formed of a plurality of rounded sections including a lower rounded section having an upper rim portion and an upper rounded section having a lower rim portion interfitting detachably with said upper rim portion, said lower section being weighted at a bottom portion thereof and said upper section having an opening formed in the top portion thereof, whereby said opening will rotate towards the direction of travel of a tissue removed from said container and when the force effecting said removal is itself removed will with said container return to its initial position.

2. A container according to claim 1 wherein said opening is formed in said upper section.

3. A container according to claim 2, wherein each of said sections is generally hemispherical.

4. A container according to claim 2, said upper rim portion having a top wall and circumferential recess spaced downwardly from said top wall; said lower rim portion including a recessed ledge portion adapted to seat upon said top wall and circumferential projection spaced downwardly from said ledge portion and adapted to fit within said recess.

5. A container according to claim 4, wherein said projection includes a wall portion extending downwardly for providing a camming surface.

6. A container according to claim 4, the wall of said upper section tapering toward said lower rim portion.

7. A container according to claim 6, said upper rim portion has a thickness less than the wall of said lower section.

8. A container for dispensing facial tissues or the like, said container comprising a rounded base section having a gravitational memory in any of 350° regardless of displacement and capable of rotation in 360°; said base section having an upper rim portion; and a detachable section having a lower rim portion and means defined in said rim portions for interfitting said detachable section to said base section; said detachable section having an opening formed in the surface thereof.

9. A container as claimed in claim 8 wherein said gravitational memory is composed of a weight mounted in the bottom of said base section and said opening in said detachable section is in diametrically opposed position to that of said weight in said bottom section.

10. A container as claimed in claims 8 or 9 wherein said opening is elongated and has opposed edges intersecting at acute angles at each end.

11. A container as claimed in claim 9 wherein said weight has a weight of 2.5 to 5 ounces.

12. A container according to claim 1 wherein said sections forming the exterior of said container are two in number.

* * * * *